United States Patent [19]

Stagg

[11] Patent Number: 4,869,323

[45] Date of Patent: Sep. 26, 1989

[54] CEMENTING AND ROTATING AN UPPER WELL CASING ATTACHED BY SWIVEL TO A LOWER CASING

[75] Inventor: Theodore O. Stagg, Anchorage, Ak.

[73] Assignee: Standard Alaska Production Company, Anchorage, Ak.

[21] Appl. No.: 155,420

[22] Filed: Feb. 12, 1988

[51] Int. Cl.[4] ..... E21B 33/14; E21B 33/16

[52] U.S. Cl. ..... 166/285; 166/116; 166/184; 166/289

[58] Field of Search ..... 166/285, 289, 116, 184, 166/185, 187, 373, 374

[56] References Cited

U.S. PATENT DOCUMENTS 3,901,318 8/1975 Fortenberry ..... 166/278
4,678,031 7/1987 Blandford et al. ..... 166/242

OTHER PUBLICATIONS

"Cementing High-Angle Wells Using Cement-Expanded Formation Packers and/or Casing Rotation", by Webster et al.; 1987; SPE/IADC 1987, Drilling Conference.

"Liner Rotation While Cementing: An Operator's Experience in South Texas"; Arceneaux et al.; 1985; SPE-/IADC Drilling Conference.

"Liner Rotation Proper Planning Improve Primary Cementing Success"; Hyatt et al., 1974.

"Guides Emerge for Cementing Horizontal Strings"; Parcevaux; 1987; Oil and Gas Journal.

*Primary Examiner*—William P. Neuder

*Attorney, Agent, or Firm*—Raymond F. Keller; David J. Untener; Larry W. Evans

[57] ABSTRACT

A method for completing a well to provide an uncemented lower casing and an upper cemented casing. The lower casing and upper casing are connected at a swivel joint so that only the upper casing is rotated while cementing. Inflatable packers and a plug are positioned at the lower casing to prevent entry of cement, while a port collar allows cement to flow into the annulus surrounding the upper casing.

The invention is particularly useful when setting long lengths of casing and when completing highly deviated or horizontal wellbores. The method also allows an existing conventionally-completed well to be re-drilled and completed as a highly-deviated or horizontal well.

20 Claims, 1 Drawing Sheet

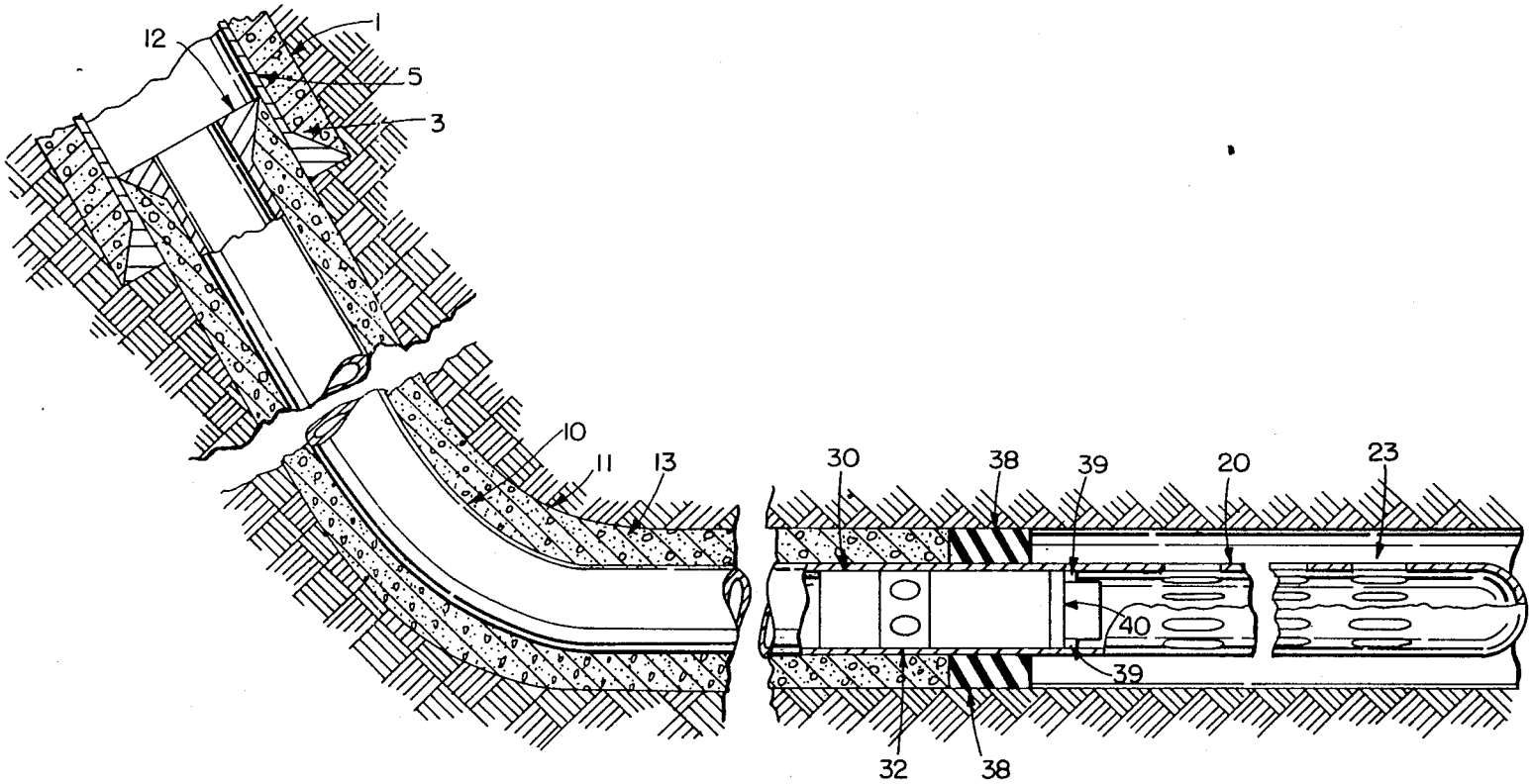
23
20
39
40
39
38
38
32
30
13
11
10
1
5
3
12

CEMENTING AND ROTATING AN UPPER WELL CASING ATTACHED BY SWIVEL TO A LOWER CASING

BACKGROUND OF THE INVENTION

1. Field of the Invention

This invention relates to a method for completing a wellbore with casing. More particularly, the invention involves a method for concurrently setting a lower uncemented casing and an upper cemented casing to allow rotation of only the upper casing while cementing.

2. Discussion of the Art

One of the most critical operations in completing a well to bring it into production is cementing the annulus between the casing and the wellbore. The cement must isolate different formations traversed by the wellbore to prevent formation fluids from moving along the annulus.

To achieve a quality cement job, the drilling mud in the annulus must be substantially displaced by cement and by preflushes which are pumped ahead of the cement. Field operations over the past two decades have demonstrated that rotating the casing during the mud displacement and cementing operation is beneficial. See, for example, the following articles: Hyatt, C. R., et al., "Liner Rotation and Proper Planning Improve Primary Cementing Success," SPE 12607 (1984); Arceneaux, M. A., "Liner Rotation While Cementing: An Operator's Experience in South Texas," SPE/IADC 13448 (1985); and Webster, M. B. et al., "Cementing High-Angle Wells Using Cement-Expanded Formation Packers and/or Casing Rotation," SPE/IADC 16136 (1987).

Although casing movement is desirable, rotation of the entire casing string during cementing has been impractical or impossible in some situations. For example, the torque required to rotate casing in deep wells or in highly deviated or horizontal wells can exceed the torsional limits of the casing or the casing threaded connections. Without casing rotation, a poor cement job can result and necessitate cement squeeze jobs or workovers.

Another alternative has been to cement a first section of casing, then continue drilling or clean out a previously drilled hole, and subsequently install another section of uncemented casing below the first. However, the wellbore and each successive casing will have a smaller diameter. The ultimate production from and physical access to the well is accordingly limited in these prior art methods.

SUMMARY OF THE INVENTION

The invention involves a method for completing a well to provide an uncemented lower casing and an upper cemented casing which can be rotated while cementing. The method comprises placing in a wellbore a lower casing and an upper casing connected at a swivel joint, temporarily plugging the lower casing with a plug, sealing the annulus between the wellbore and the lower casing at a point higher than the plug, opening a port in the casing at a location higher than the sealed annulus point to allow cement to flow into the annulus surrounding the upper casing, and rotating only the upper casing while cementing.

BRIEF DESCRIPTION OF THE DRAWING

The sole FIGURE is a cross-section showing a portion of a well completed with casing set by the method of the invention.

DESCRIPTION OF THE PREFERRED EMBODIMENTS

This invention generally concerns placement of two portions of a casing string concurrently, and then rotating only the upper portion during cementing, as described below.

The invention is useful when it is critical to isolate certain zones with cement in an upper section of the borehole, but a lower section can remain uncemented. It is particularly useful when setting long lengths of casing and when completing highly deviated or horizontal wellbores because of the difficulty in achieving a good cement job in lengthy or angled wellbores.

A further advantage of the inventive method is that it allows an existing conventionally-completed well to be re-drilled and completed as a highly-deviated or horizontal well. The casing wall can be milled out and a drainhole can be drilled at an angle or horizontally from the original wellbore. Because the new production casing is necessarily smaller than the casing diameter of original well, the invention provides a means for effectively cementing critical zones along the new casing while maintaining the maximum-diameter uncemented casing in the production zone.

The well to be completed can be newly drilled or it can be an existing, previously completed well. All or only a portion of the well can be completed using this method. The casing string consists of lower and upper casing connected by a swivel joint. Because both the lower and upper casing are run into the well at the same time, the lower casing in one embodiment of this invention can have the same diameter as the upper casing. The maximum diameter of the lower casing is, of course, limited by the size of the borehole or any previously set casing. However, the lower casing may optionally have a diameter larger or smaller than the upper casing.

The lower casing used in this invention need not be cemented in place. If the lower casing is placed through the producing formation, preferably at least a portion is slotted or perforated to permit production.

Referring to the FIGURE, a cross-section profile of a completed well is shown. The well depicted has a high-angle section shown at upper left which builds to a horizontal section. Of course, this invention is also useful in wells having other angled profiles, and in vertical wells.

Both the lower casing 20 and the upper casing 10 attached by swivel joint 30 are run into the wellbore 11 at the same time. The top of the upper casing 10 can extend all the way to the top of the well (not shown), or it may extend only to within another casing 5 as shown. In deep wells, the upper casing is preferably suspended from a rotatable liner hanger 12 within a larger casing 5. The annulus between casing 5 and the larger wellbore 1 is often filled with cement 3.

When the casing string reaches the desired position in the wellbore 11, the lower casing is plugged so that cement will not enter the lower casing. This is readily done, for example, by pumping down the casing a wiper plug 40 which seats on landing collar or nipple 39. An alternative is to pre-install a plug or insert an upside down float collar in the casing before it enters the well. However, this alternative would not allow circulation of drilling mud prior to opening the port collar.

The annulus 23 between the wellbore 11 and lower casing 20 must now be sealed to prevent cement from flowing down the annulus. This is conveniently accomplished by an expandable formation packer 38 which is situated higher than the plug. With the lower casing sealed, the pressure of the drilling mud (not shown) in the casing 10 can be increased to open pressure valves to fill the packer with mud and then close the valve to set the packer tightly in the annular space.

Examples of suitable packers for this invention include the PAYZONE TM Packer available from Completion Tool Company, Houston, Tex., and the LYNES inflatable packer. Although mud-filled packers are preferred, cement-filled packers can also be used.

Once the interior and the annulus of the lower casing are sealed, the upper casing can be cemented. An opening must be provided above the packer and plug in order to allow cement to flow into the annulus 13 between the upper casing 10 and the wellbore 11. Although the cement could be pumped into the annulus by perforating the casing at this point, it is preferred to use a port collar 32 at this point which can be opened and closed by hydraulic or mechanical action. For example, a slip joint port collar can be mechanically opened by raising the upper casing a few inches after anchoring the lower casing by inflating the packer. After the preflush and cement has been pumped down, the upper casing is lowered to close the port.

One preferred method is to use a hydraulic port collar 32, such as those manufactured by Halliburton, Texas Iron Works, and others, which can be opened by increasing drilling mud pressure. Certain hydraulic port collars have a spring-loaded port that closes when the mud pressure is released.

An method is also available for mechanically closing the port collar with a plug, and is preferred when the upper casing is suspended from a liner hanger. A "drill pipe wiper plug" plug is pumped down the drill pipe, and latches into a second "liner wiper plug" which has been carried in and held in position by the liner hanger running tool. The combination plug then is pumped to the port collar where the plug lands on a profile in the port collar, and applied pressure forces the port collar closed. This assembly is available from Texas Iron Works.

If desired, the port collar may be left open after cementing the well. An open port collar would not be highly detrimental if the position of the port collar is favorable. For example, if the port collar is positioned within the pay zone, it could be left open. It is also possible to delete the port collar and gain access to the casing annulus by perforating the liner, but this is less preferred.

The port collar can be located on either side of swivel joint 30, but is preferably located between the packer 38 and swivel 30 to allow the most effective displacement of drilling mud.

It is essential that the upper casing be capable of rotating during cementing, for the reasons discussed above. A swivel joint, such as that manufactured by Texas Iron Works of Houston, Tex., or Bateman Oil Tools Company of Ventura, Calif., is connected between the upper casing and lower casing. The speed and duration of the rotation are chosen according to conventional guidelines known in the art.

With the above method completed, the well can then be brought into production using conventional techniques.

Although a preferred embodiment has been described in detail, it should be understood that various substitutions and changes may become apparent to those skilled in the art. These modifications may be made without departing from the scope of the invention as defined by the claims.

I claim:

1. A method for completing a well to provide an uncemented lower casing and an upper cemented casing which can be rotated while cementing, the method comprising:

(a) placing in a wellbore a lower casing and an upper casing connected at a swivel joint, (b) temporarily plugging the lower casing with a plug, (c) sealing the annulus between the wellbore and the lower casing at a sealed annulus point higher than the plug to prevent cement from flowing down the annulus into an uncemented portion of the annulus surrounding the lower casing, (d) opening a port in the casing at a location higher than the sealed annulus point to allow cement to flow into the annulus surrounding the upper casing, (e) pumping cement through the port and into the annulus surrounding the upper casing, and (f) rotating only the upper casing while cementing.

2. The method of claim 1 in which the lower casing is temporarily plugged by a wiper plug which is pumped down the casing to seat on a landing collar.

3. The method of claim 1 in which the lower casing annulus is sealed by expanding a formation packer.

4. The method of claim 3 in which the formation packer is expanded with drilling mud by increasing pressure of drilling mud within the casing.

5. The method of claim 1 in which the port is opened by mechanical action.

6. The method of claim 1 in which the port is opened by hydraulic means.

7. The method of claim 6 in which the port is closed by a wiper plug which is pumped down the casing.

8. The method of claim 1 in which (a) the lower casing is plugged by pumping drilling mud behind a plug which seats at a landing collar in the lower casing, (b) the annulus between the wellbore and the lower casing is sealed by increasing the pressure of the pumped drilling mud to thereby inflate and subsequently seal a packer located at a point above the plug, (c) the pressure of the drilling mud is further increased to open a port collar located above the packer, and (d) the annulus surrounding the upper casing is cemented while rotating the upper casing.

9. A well assembly comprising:

(a) an uncemented first casing in a lower portion of a wellbore, (b) a second casing in an upper portion of the wellbore connected to the first casing by a swivel joint, (c) an annulus formed between the wellbore and the first and second casings, (d) annulus sealing means situated below and near the swivel joint for sealing the annulus to prevent cement from flowing down the annulus into an uncemented portion of the annulus surrounding the first casing (e) plugging means for temporarily plugging the first casing at a point below said annulus sealing means, and (f) means for introducing cement into the annulus at a location higher than said annulus sealing means.

10. The well of claim 9 in which the diameter of the second casing is the same or less than the diameter of the first casing.

11. The well of claim 9 in which the diameter of the second casing is greater than the diameter of the first casing.

12. The well of claim 9 in which the annulus sealing means includes an expandable formation packer.

13. The well of claim 12 in which the packer is filled with drilling mud.

14. The well of claim 12 in which the packer is filled with cement.

15. The well of claim 9 in which the plugging means includes a wiper plug.

16. The well of claim 9 in which the plugging means includes a pre-installed plug or upside down float collar.

17. The well of claim 9 in which the means for introducing cement into the annulus, includes a port collar.

18. The well of claim 9 in which the annulus sealing means comprises a mud filled formation packer, and the cement introducing means comprises a port collar.

19. The well of claim 9 in which the second casing is suspended from a liner hanger designed for liner rotation.

20. The well of claim 9 in which the second casing is suspended from the wellhead at the earth's surface.

* * * * *